US007472065B2

(12) United States Patent
Aaron et al.

(10) Patent No.: US 7,472,065 B2
(45) Date of Patent: Dec. 30, 2008

(54) GENERATING PARALINGUISTIC PHENOMENA VIA MARKUP IN TEXT-TO-SPEECH SYNTHESIS

(75) Inventors: Andrew S. Aaron, Ardsley, NY (US); Raimo Bakis, Briarcliff Manor, NY (US); Ellen M. Eide, Bedford Hills, NY (US); Wael Hamza, Tarrytown, NY (US)

(73) Assignee: International Business Machines Corporation, Armonk, NY (US)

( * ) Notice: Subject to any disclaimer, the term of this patent is extended or adjusted under 35 U.S.C. 154(b) by 904 days.

(21) Appl. No.: 10/861,055

(22) Filed: Jun. 4, 2004

(65) Prior Publication Data

US 2005/0273338 A1 Dec. 8, 2005

(51) Int. Cl.
*G10L 13/00* (2006.01)
*G10L 13/08* (2006.01)

(52) U.S. Cl. ..... 704/258; 704/260; 704/266

(58) Field of Classification Search ..... 704/258, 704/260, 261, 266, 267, 269; 379/88.16
See application file for complete search history.

(56) References Cited

U.S. PATENT DOCUMENTS 5,734,794 A * 3/1998 White ..... 704/275
5,966,691 A * 10/1999 Kibre et al. ..... 704/260
6,101,470 A * 8/2000 Eide et al. ..... 704/260
6,226,614 B1 * 5/2001 Mizuno et al. ..... 704/260
6,446,040 B1 * 9/2002 Socher et al. ..... 704/260
6,792,406 B1 * 9/2004 Fujimura et al. ..... 704/257
6,804,649 B2 * 10/2004 Miranda ..... 704/258
6,847,931 B2 * 1/2005 Addison et al. ..... 704/260
6,963,839 B1 * 11/2005 Ostermann et al. ..... 704/260
7,062,437 B2 * 6/2006 Kovales et al. ..... 704/260
7,062,438 B2 * 6/2006 Kobayashi et al. ..... 704/260
7,103,548 B2 * 9/2006 Squibbs et al. ..... 704/260
2003/0093280 A1 * 5/2003 Oudeyer ..... 704/266
2003/0158734 A1 * 8/2003 Cruickshank ..... 704/260
2004/0107101 A1 * 6/2004 Eide ..... 704/260
2004/0111271 A1 * 6/2004 Tischer ..... 704/277
2005/0071163 A1 * 3/2005 Aaron et al. ..... 704/260

* cited by examiner

*Primary Examiner*—Martin Lerner
(74) *Attorney, Agent, or Firm*—F. Chau & Associates, LLC

(57) ABSTRACT

Converting marked-up text into a synthesized stream includes providing marked-up text to a processor-based system, converting the marked-up text into a text stream including vocabulary items, retrieving audio segments corresponding to the vocabulary items, concatenating the audio segments to form a synthesized stream, and audibly outputting the synthesized stream, wherein the marked-up text includes a normal text and a paralinguistic text; and wherein the normal text is differentiated from the paralinguistic text by using a grammar constraint, and wherein the paralinguistic text is associated with more than one audio segment, wherein the retrieving of the plurality audio segments includes selecting one audio segment associated with the paralinguistic text.

25 Claims, 2 Drawing Sheets

Marked-up text: <prosody style = "bad news" \ > Well \sigh no <prosody \ >

Vocabulary items: Well ~bad.news.sigh no.

GENERATING PARALINGUISTIC PHENOMENA VIA MARKUP IN TEXT-TO-SPEECH SYNTHESIS

BACKGROUND OF THE INVENTION

1. Field of the Invention

The present invention relates to text-to-speech ("TTS"), and, more particularly, to generating paralinguistic events in synthetic speech.

2. Description of the Related Art

Many businesses utilize automated telephone systems as a means for efficiently interacting with callers. A business creates a series of prewritten text responses to potential questions/answers by callers. When a caller speaks to a voice recognition system, a computer responds by reading the corresponding prewritten text. The computer's response is audibly and automatically produced for the caller using text-to-speech software.

Text-to-speech ("TTS") is the generation of synthesized speech from text. Primary TTS goals include making synthesized speech as intelligible, natural and pleasant to listen to as human speech, and to have it communicate just as meaningfully.

SUMMARY OF THE INVENTION

In one exemplary aspect of the present invention, a method of converting marked-up text into a synthesized stream includes providing marked-up text to a processor-based system; converting the marked-up text into a text stream comprising a plurality of vocabulary items; retrieving a plurality of audio segments corresponding to the plurality of vocabulary items; concatenating the plurality of audio segments to form a synthesized stream; and audibly outputting the synthesized stream; wherein the marked-up text comprises a normal text and a paralinguistic text; wherein the normal text is differentiated from the paralinguistic text by using a grammar constraint, and wherein the paralinguistic text is associated with more than one audio segment, wherein the retrieving of the plurality audio segments comprises selecting one audio segment associated with the paralinguistic text.

In a second exemplary aspect of the present invention, a method of converting paralinguistic text into a synthesized stream includes providing paralinguistic text to a processor-based system; converting the paralinguistic into a text stream comprising a plurality of vocabulary items; retrieving a plurality of audio examples corresponding to the plurality of vocabulary items; concatenating the plurality of audio examples to form a synthesized stream; and audibly outputting the synthesized stream, wherein the paralinguistic text comprises non-speech sounds indicating an emotional state underlying the paralinguistic text, and wherein the paralinguistic text is associated with more than one audio segment, wherein the retrieving of the plurality audio segments comprises selecting one audio segment associated with the paralinguistic text.

In a third exemplary aspect of the present invention, a system of converting marked-up text into a synthesized stream includes means for providing marked-up text to a processor-based system; means for converting the marked-up text into a text stream comprising a plurality of vocabulary items; means for retrieving a plurality of audio examples corresponding to the plurality of vocabulary items; means for concatenating the plurality of audio examples to form a synthesized stream; and means for audibly outputting the synthesized stream; wherein the marked-up text comprises a normal text and a paralinguistic text; and wherein the normal text is differentiated from the paralinguistic text by using a grammar constraint, and wherein the paralinguistic text is associated with more than one audio segment, wherein the retrieving of the plurality audio segments comprises selecting one audio segment associated with the paralinguistic text.

In a fourth exemplary aspect of the present invention, a program storage device readable by machine, tangibly embodying a program of instructions executable by the machine to perform method steps for converting marked-up text into a synthesized stream is provided. The method steps include providing marked-up text to a processor-based system; converting the marked-up text into a text stream comprising a plurality of vocabulary items; retrieving a plurality audio segments corresponding to the plurality of vocabulary items; concatenating the plurality of audio segments to form a synthesized stream; and audibly outputting the synthesized stream; wherein the marked-up text comprises a normal text and a paralinguistic text; wherein the normal text is differentiated from the paralinguistic text by using a grammar constraint, and wherein the paralinguistic text is associated with more than one audio segment, wherein the retrieving of the plurality audio segments comprises selecting one audio segment associated with the paralinguistic text.

In a fifth exemplary aspect of the present invention, a program storage device readable by machine, tangibly embodying a program of instructions executable by the machine to perform method steps for converting paralinguistic text into a synthesized stream is provided. The method steps include providing paralinguistic text to a processor-based system; converting the paralinguistic into a text stream comprising a plurality of vocabulary items; retrieving a plurality of audio examples corresponding to the plurality of vocabulary items, concatenating the plurality of audio examples to form a synthesized stream; and audibly outputting the synthesized stream; wherein the paralinguistic text comprise non-speech sounds indicating an emotional state underlying the paralinguistic text, and wherein the paralinguistic text is associated with more than one audio segment, wherein the retrieving of the plurality audio segments comprises selecting one audio segment associated with the paralinguistic text.

BRIEF DESCRIPTION OF THE DRAWINGS

The invention may be understood by reference to the following description taken in conjunction with the accompanying drawings, in which like reference numerals identify like elements, and in which.

DETAILED DESCRIPTION OF PREFERRED EMBODIMENTS

Figure 1:
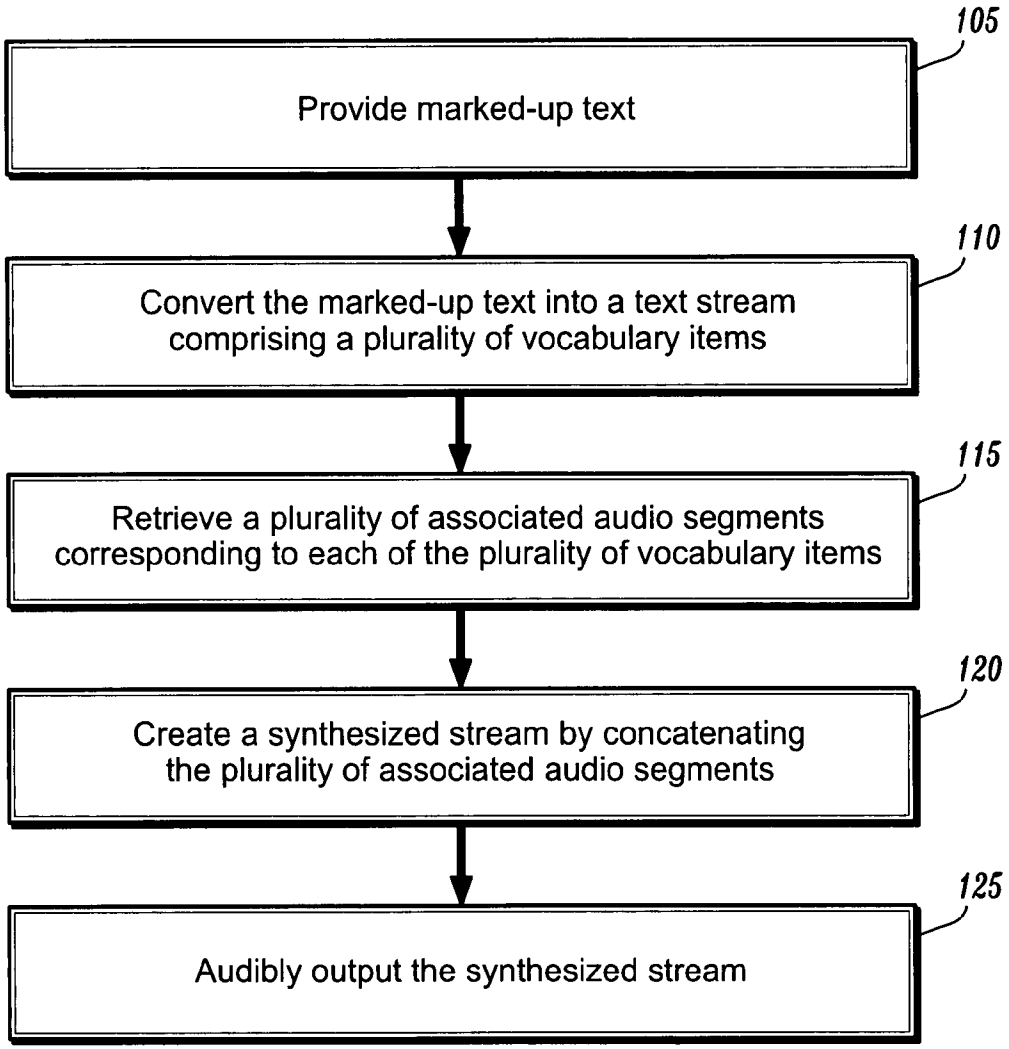
FIG. 1 depicts a method of converting marked-up text into a synthesized stream, in accordance with one embodiment of the present invention.

Illustrative embodiments of the invention are described below. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims. It should be understood that the systems and methods described herein may be implemented in various forms of hardware, software, firmware, or a combination thereof.

It is to be understood that the systems and methods described herein may be implemented in various forms of hardware, software, firmware, special purpose processors, or a combination thereof. In particular, at least a portion of the present invention is preferably implemented as an application comprising program instructions that are tangibly embodied on one or more program storage devices (e.g., hard disk, magnetic floppy disk, RAM, ROM, CD ROM, etc.) and executable by any device or machine comprising suitable architecture, such as a general purpose digital computer having a processor, memory, and input/output interfaces. It is to be further understood that, because some of the constituent system components and process steps depicted in the accompanying Figures are preferably implemented in software, the connections between system modules (or the logic flow of method steps) may differ depending upon the manner in which the present invention is programmed. Given the teachings herein, one of ordinary skill in the related art will be able to contemplate these and similar implementations of the present invention.

In typical conversation, humans convey a combination of speech as well as paralinguistic events. As used herein, "speech" refers to spoken words, and "paralinguistic events" refer to sounds made by a speaker which do not have a word equivalent, i.e., they would not typically be committed to paper by someone transcribing the speech, but which modify the message being conveyed and generally add information about the emotional state of the speaker. For example, a sigh is a paralinguistic event which may be added to speech to express distress or unhappiness. Other examples of paralinguistic events include, but are not limited to, breaths, coughs, sighs, laughter, filled pauses (e.g., uh, um) and hesitations (e.g., mmm).

A developer or driving application may desire a particular paralinguistic event to occur at a particular point in the audio stream. This ability may be enabled through the use of markup. The use of markup allows paralinguistic events to be treated as part of the speech vocabulary, thus allowing a user to seamlessly insert paralinguistic events into the text. The developer can develop a grammar constraint (e.g., markup) for differentiating text that is to be spoken from commands inserting a paralinguistic event. For example, the developer may specify:

<prosody style="bad news">Well, \sigh I cannot answer that question<\prosody>

The inclusion of "\sigh" commands the TTS software to insert a particular paralinguistic event between two words. Although a backslash is used above to specify a paralinguistic event in the preceding example, it is understood that any of a variety of grammar notations may be used as contemplated by those skilled in the art.

It is also noted that the style of the speech (i.e., "bad news") is noted for purposes of prosody (i.e., pitch and duration). In other embodiments, the style of the speech may affect the type of paralinguistic event chosen for insertion into the audio stream. For example, the developer may have audio segments for a sad sigh and an angry sigh. Further, the type of paralinguistic event noted may affect the prosody of speech surrounding the event. For example, the TTS software may take into account the differences in prosody of the word "well" between saying the "well, \sigh" and "well, \laugh"—the prior being spoken in an emotional state of sadness (i.e., sighing) and the latter being spoken in an emotional state of happiness (i.e., laughter). Also, the TTS software may take into account the differences in prosody of the word "well" between saying "well, I" and "well, \sigh I"—the prior "well," being spoken without a sigh, perhaps having a shorter duration and flatter pitch than the latter.

Audio segments of the paralinguistic events may be prerecorded and stored on a database. As noted above, multiple versions of the same paralinguistic event may be recorded to provide natural-sounding variation in the case of multiple instances of a given event, i.e., a sentence containing two sighs. Additionally, multiple versions of the same paralinguistic event may be recorded to convey different acoustic contexts, different emotions and different types of speakers. For example, a sigh by a male may sound different from a sigh by a female. Note, however, that in a preferred embodiment, the paralinguistic events are generated and recorded from the same speaker who recorded the speech database.

To be able to include paralinguistic events in our TTS output, we prerecord one or more example of each event we are interested in generating. As previously mentioned, in a preferred embodiment, the same speaker who recorded the database of speech is recorded while generating the desired paralinguistic events. The speaker is asked to generate these events, possibly by reading a script that contains them. For example, the speaker might be instructed to read "Oh, \chuckle that's funny," where the \chuckle is an indication for the speaker to produce that paralinguistic event. After the recordings are made, the paralinguistic events are excised from the surrounding audio, and the resulting snippets of audio are labeled with the paralinguistic event they represent. Optionally, the labels may convey both the paralinguistic event and the expressive state of the speaker. For example, a speaker may instructed to sigh during a section of angry speech, in which case the audio corresponding to that sigh may be labeled as ~angry_sigh. The labeled snippets of nonverbal audio are then stored along with the examples of speech sounds already stored in the TTS database.

Referring now to FIG. 1, a method of converting speech and paralinguistic events into a synthesized stream is shown, in accordance with one embodiment of the present invention. Marked-up text is provided (at 105). Marked-up text comprises "normal text" and "paralinguistic text." Normal text refers to the text that is to be spoken by the computer (i.e., speech). Paralinguistic text, as the name implies, is the text referring to a particular paralinguistic event. As previously noted, normal text and paralinguistic text may be differentiated through the use of grammar constraints (e.g., markup).

The marked-up text is converted (at 110) into a text stream comprising a plurality of vocabulary items. The normal text part of the marked-up text may be converted using any of a variety of internal representations known to those skilled in the art. The paralinguistic text part of the marked-up text is converted into the vocabulary items unique to the paralinguistic text. Associated audio segments are retrieved (at 115) corresponding to each of the plurality of vocabulary items in the text stream. The audio segments may be retrieved from a local or remote database. Further, it is understood that the audio segments for the normal text and the audio segments for the paralinguistic text may be stored on the same or separate databases.

A synthesized stream is created (at 120) by concatenating the audio segments. A processor-based system, such as a computer, audibly outputs (at 125) the synthesized stream. For example, the synthesized stream may be audibly output through stereo speakers.

A paralinguistic text may have more than one associated audio segment. As noted above, for example, two types of sighs, a sad one and an angry one, may be prerecorded. In one embodiment, used preferably when two examples of the same type of sigh are prerecorded, the audio segment is be chosen randomly. In an alternate embodiment, the audio segment is strictly predetermined by a user. That is, if the user wants an angry sigh, the user would use a specific paralinguistic text, such as "\angrysigh," to expressly request the angry sigh. In yet another embodiment, the audio segment is chosen based on the overall emotional context of the marked-up text. For example, certain combinations of spoken words and paralinguistic events may correspond to a known emotion. The associated audio segments retrieved (at 115) may include an angry sigh audio segment for the paralinguistic text "\sigh" (i.e., a generic request for a sigh) when the overall emotional context of the marked-up text expresses anger.

Further, it is understood that the prosody of a spoken words may vary depending on the surrounding paralinguistic events. As previously mentioned, a sentence spoken with a laughter paralinguistic event is generally distinct from the same sentence spoken with an anger paralinguistic event. Thus, the prosody of the spoken words may be altered during the creation (at 120) or the output ( at 125) of the audio stream.

Suppose a developer provides (at 105) the following marked-up text:

I \cough have a cold.

The text is converted (at 110) into a text stream. In one embodiment, the normal text "I", "have", "a" and "cold" are converted into phonemes, and the paralinguistic text \cough is converted (at 110) into a "cough" vocabulary item. For example, step 110 may yield the following:

I ~cough have a cold.

The ~cough vocabulary item will have one or more audio examples stored in a database. The associated audio segments are found (at 115) for each of the vocabulary items. When more than one stored example is found, an audio segment may be randomly selected, or chosen based on any of a variety of contexts, such as the speaker's mood and the type of speaker. A synthesized stream is created (at 120) and audibly output (at 125) by a processor-based system, such as a computer.

As an additional example, consider synthesizing the following:

<prosody style="bad news">Well, \sigh no.<\prosody>

Figure 2:
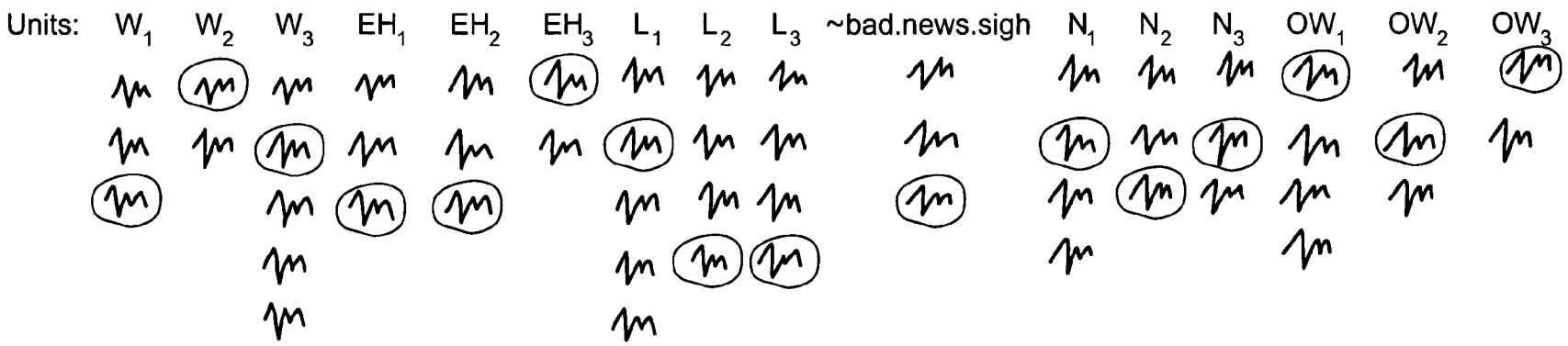
FIG. 2 depicts a synthesis of an exemplary marked-up text, in accordance with one embodiment of the present invention.

This would be interpreted by the TTS engine as speaking the words "well" and "no" in a style which is appropriate for conveying bad news, with a sigh appropriate in a bad-news context inserted between the two words. Internally, the synthesizer would be faced with the problem of selecting examples of each speech and non-speech sound to construct that message, as illustrated in FIG. 2. In this example, there are three tokens of the bad-news-sigh events from which to choose. The synthesizer would use a cost function to compare each example of each sub-word unit and each paralinguistic event to a set of targets such as pitch, duration, and energy, as well as to adjacent candidates, to find the optimal set of units to comprise this sentence. The optimal path is indicated by the circled units, which would be concatenated together to form the synthetic utterance.

The particular embodiments disclosed above are illustrative only, as the invention may be modified and practiced in different but equivalent manners apparent to those skilled in the art having the benefit of the teachings herein. Furthermore, no limitations are intended to the details of design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of converting marked-up text into a synthesized stream, comprising:

providing marked-up text to a processor-based system;

converting the marked-up text into a text stream comprising a plurality of vocabulary items;

retrieving a plurality audio segments corresponding to the plurality of vocabulary items;

concatenating the plurality of audio segments to form a synthesized stream; and audibly outputting the synthesized stream;

wherein the marked-up text comprises a normal text and a paralinguistic text;

wherein the normal text is differentiated from the paralinguistic text by using a grammar constraint; and wherein the paralinguistic text is associated with more than one audio segment, wherein the retrieving of the plurality audio segments comprises selecting one audio segment associated with the paralinguistic text.

2. The method of claim 1, wherein the paralinguistic text comprises non-speech sounds.

3. The method of claim 2, wherein the non-speech sounds comprise at least one of a breath, a cough, a sigh, a filled pause, and a hesitation.

4. The method of claim 1, wherein the normal text comprises speech sounds.

5. The method of claim 4, wherein the speech sounds comprise sounds with a word equivalent.

6. The method of claim 1, farther comprising determining an emotional context of the marked-up text.

7. The method of claim 6, wherein the step of retrieving further comprises choosing the plurality of audio segments corresponding to the emotional context of the marked-up text, wherein the selected one audio segment associated with the paralinguistic text is selected according to the emotional context.

8. The method of claim 6, wherein the step of concatenating further comprises concatenating the plurality of audio segments based on the emotional context of the marked-up text.

9. The method of claim 8, wherein concatenating the plurality of audio segments based on the emotional context of the marked-up text comprises setting the prosody of the synthesized stream based on the emotional context of the marked-up text.

10. The method of claim 6, wherein the step of audibly outputting the synthesized stream comprises audibly outputting the synthesized stream based on the emotional context of the marked-up text, wherein the selected one audio segment associated with the paralinguistic text is selected randomly.

11. The method of claim 10, wherein the step of audibly outputting the synthesized stream based on the emotional context of the marked-up text comprises audibly outputting the synthesized stream at a prosody based on the emotional context of the marked-up text.

12. A method of converting paralinguistic text into a synthesized stream, comprising:

providing paralinguistic text to a processor-based system;

converting the paralinguistic into a text stream comprising a plurality of vocabulary items;

retrieving a plurality of audio examples corresponding to the plurality of vocabulary items;

concatenating the plurality of audio examples to form a synthesized stream; and audibly outputting the synthesized stream;

wherein the paralinguistic text comprise non-speech sounds indicating an emotional state underlying the paralinguistic text; and wherein the paralinguistic text is associated with more than one audio segment, wherein the retrieving of the plurality audio segments comprises selecting one audio segment associated with the paralinguistic text.

13. The method of claim 12, wherein the non-speech sounds comprise at least one of a breath, a cough, a sigh, a filled pause, and a hesitation.

14. A system of converting marked-up text into a synthesized stream, comprising:

means for providing marked-up text to a processor-based system;

means for converting the marked-up text into a text stream comprising a plurality of vocabulary items;

means for retrieving a plurality of audio examples corresponding to the plurality of vocabulary items;

means for concatenating the plurality of audio examples to form a synthesized stream; and means for audibly outputting the synthesized stream;

wherein the marked-up text comprises a normal text and a paralinguistic text; and wherein the normal text is differentiated from the paralinguistic text by using a grammar constraint; and wherein the paralinguistic text is associated with more than one audio segment, wherein the retrieving of the plurality audio segments comprises selecting one audio segment associated with the paralinguistic text.

15. The system of claim 14, wherein the normal text comprises speech sounds and the paralinguistic text comprises non-speech sounds.

16. The system of claim 15, wherein the non-speech sounds comprise at least one of a breath, a cough, a sigh, a filled pause, and a hesitation.

17. The system of claim 16, wherein the plurality of audio examples are prerecorded.

18. The system of claim 17, wherein the plurality of audio examples are prerecorded using one speaker.

19. The system of claim 17, wherein the plurality of audio examples are prerecorded using a plurality of speakers.

20. The system of claim 14, wherein the plurality of audio examples corresponding to the plurality of vocabulary items comprises at least one audio example corresponding to each of the plurality of vocabulary items.

21. The system of claim 14, wherein each of the plurality of vocabulary items comprises a phoneme.

22. The system of claim 14, wherein the grammar constraint comprises markup.

23. The system of claim 14, further comprising a database for storing the plurality of audio examples.

24. A program storage device readable by machine, tangibly embodying a program of instructions executable by the machine to perform method steps for converting marked- up text into a synthesized stream, the method steps comprising:

providing marked-up text to a processor-based system;

converting the marked-up text into a text stream comprising a plurality of vocabulary items;

retrieving a plurality audio segments corresponding to the plurality of vocabulary items;

concatenating the plurality of audio segments to form a synthesized stream; and audibly outputting the synthesized stream;

wherein the marked-up text comprises a normal text and a paralinguistic text;

wherein the normal text is differentiated from the paralinguistic text by using a grammar constraint; and wherein the paralinguistic text is associated with more than one audio segment, wherein the retrieving of the plurality audio segments comprises selecting one audio segment associated with the paralinguistic text.

25. A program storage device readable by machine, tangibly embodying a program of instructions executable by the machine to perform method steps for converting paralinguistic text into a synthesized stream, the method steps comprising:

providing paralinguistic text to a processor-based system;

converting the paralinguistic into a text stream comprising a plurality of vocabulary items;

retrieving a plurality of audio examples corresponding to the plurality of vocabulary items;

concatenating the plurality of audio examples to form a synthesized stream; and audibly outputting the synthesized stream;

wherein the paralinguistic text comprise non-speech sounds indicating an emotional state underlying the paralinguistic text; and wherein the paralinguistic text is associated with more than one audio segment, wherein the retrieving of the plurality audio segments comprises selecting one audio segment associated with the paralinguistic text.

* * * * *